US010472125B2

(12) United States Patent
Franic

(10) Patent No.: US 10,472,125 B2
(45) **Date of Patent: *Nov. 12, 2019**

(54) RELATING TO PACKAGING

(71) Applicant: Elopak Systems AG, Glattbrugg (CH)

(72) Inventor: Ivica Franic, Vienna (AT)

(73) Assignee: Elopak Systems AG, Glattbrug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/248,904

(22) Filed: Aug. 26, 2016

(65) Prior Publication Data

US 2016/0362221 A1 Dec. 15, 2016

Related U.S. Application Data

(63) Continuation of application No. 12/998,919, filed as application No. PCT/EP2009/067579 on Dec. 18, 2009, now Pat. No. 9,452,859.

(30) Foreign Application Priority Data

Dec. 18, 2008 (GB) ..... 0823051.8

(51) Int. Cl.

| | |
|---|---|
| ***B65D 5/06*** | (2006.01) |
| ***B65D 5/74*** | (2006.01) |
| ***B65D 5/40*** | (2006.01) |
| ***B65D 5/42*** | (2006.01) |

(52) U.S. Cl.
CPC ..... *B65D 5/746* (2013.01); *B65D 5/067* (2013.01); *B65D 5/4266* (2013.01)

(58) Field of Classification Search
CPC ..... B65D 5/445; B65D 5/001; B65D 5/0075; B65D 5/005; B65D 5/5054
USPC ..... 229/122.32, 122.33, 199, 918
See application file for complete search history.

(56) References Cited

U.S. PATENT DOCUMENTS

| | | | | |
|---|---|---|---|---|
| 2,321,139 | A | 6/1943 | Gruger | |
| 3,185,375 | A | 5/1965 | Thomas | |
| 3,349,988 | A | 10/1967 | Horning | |
| 3,471,076 | A | 10/1969 | Crawford | |
| 5,785,240 | A | 7/1998 | Showler et al. | |
| 5,848,749 | A | 12/1998 | Ljungstrom | |
| 6,142,364 | A | 11/2000 | Laker et al. | |
| 6,182,887 | B1 | 2/2001 | Ljunstrom et al. | |
| D623,537 | S * | 9/2010 | Berman | D9/708 |
| 2006/0144912 | A1 | 7/2006 | Franic | |

(Continued)

FOREIGN PATENT DOCUMENTS

| | | |
|---|---|---|
| EP | 0438735 A1 | 7/1991 |
| EP | 0463446 A2 | 1/1992 |
| EP | 1332969 A1 | 8/2003 |

(Continued)

*Primary Examiner* — Christopher R Demeree
(74) *Attorney, Agent, or Firm* — Christian D. Abel

(57) ABSTRACT

A carton blank for forming a carton, and comprising a row of first, second, third and fourth substantially four-edged panels, each panel having substantially the same width and comprising a side wall part, a top closure obturating part and a top sealing fin part, one of said panels from an outermost boundary of the side wall part to an outermost boundary of the top closure obturating part being substantially free from any lateral line of weakness, the obturating part of said one of said panels including a loop of weakness.

14 Claims, 9 Drawing Sheets

(56) References Cited

U.S. PATENT DOCUMENTS

| | | | |
|---|---|---|---|
| 2006/0255110 | A1 | 11/2006 | Kaneko |
| 2007/0170233 | A1 | 7/2007 | Fontanazzi |

FOREIGN PATENT DOCUMENTS

| | | | |
|---|---|---|---|
| JP | H11236027 | A | 8/1999 |
| JP | 2000289736 | A | 10/2000 |
| JP | 2002234524 | A | 8/2002 |
| WO | 2004076302 | A1 | 9/2004 |

* cited by examiner

RELATING TO PACKAGING

This application is a continuation of U.S. patent application Ser. No. 12/998,919, filed Aug. 30, 2011 which is a National Stage of International Application No. PCT/EP2009/067579, filed Dec. 18, 2009. This application claims priority to United Kingdom Patent Application No. 0823051.8, filed on Dec. 18, 2008. The disclosures of the above applications are incorporated herein by reference.

This invention relates to a packaging carton of semi-rigid packaging material.

According to a first aspect of the present invention, there is provided a carton blank for forming a carton, and comprising a row of first, second, third and fourth substantially four-edged panels, each panel having substantially the same width and comprising a side wall part, a top closure obturating part and a top sealing fin part, one of said panels from an outermost boundary of the side wall part to an outermost boundary of the top closure obturating part being substantially free from any lateral line of weakness, the obturating part of said one of said panels including a loop of weakness.

According to a second aspect of the present invention, there is provided a carton comprising a loop of first, second, third and fourth substantially four-edged panels, each panel having substantially the same width and comprising a side wall part, a top closure obturating part and a top sealing fin part, one of said panels from an outermost boundary of the side wall part to an outermost boundary of the top closure obturating part being substantially free from any lateral line of weakness, the obturating part of said one of said panels including a loop of weakness.

Owing to these aspects, greater flexibility can be achieved in the size of the through-flow cross-sectional area of a pour spout fitment to be attached to the carton and/or in the number of machine parts needed for forming the top closure of the carton.

Where there is no line of weakness between the obturating part and the sealing fin part, a carton can include a top closure having a rearwardly slanted top-fin, with a front top sealing fin part being co-planar with a front top closure obturating part, the slanted top fin being more likely to remain in the desired rearward slanted position because of the absence of any line of weakness of the character mentioned.

Figure 1:
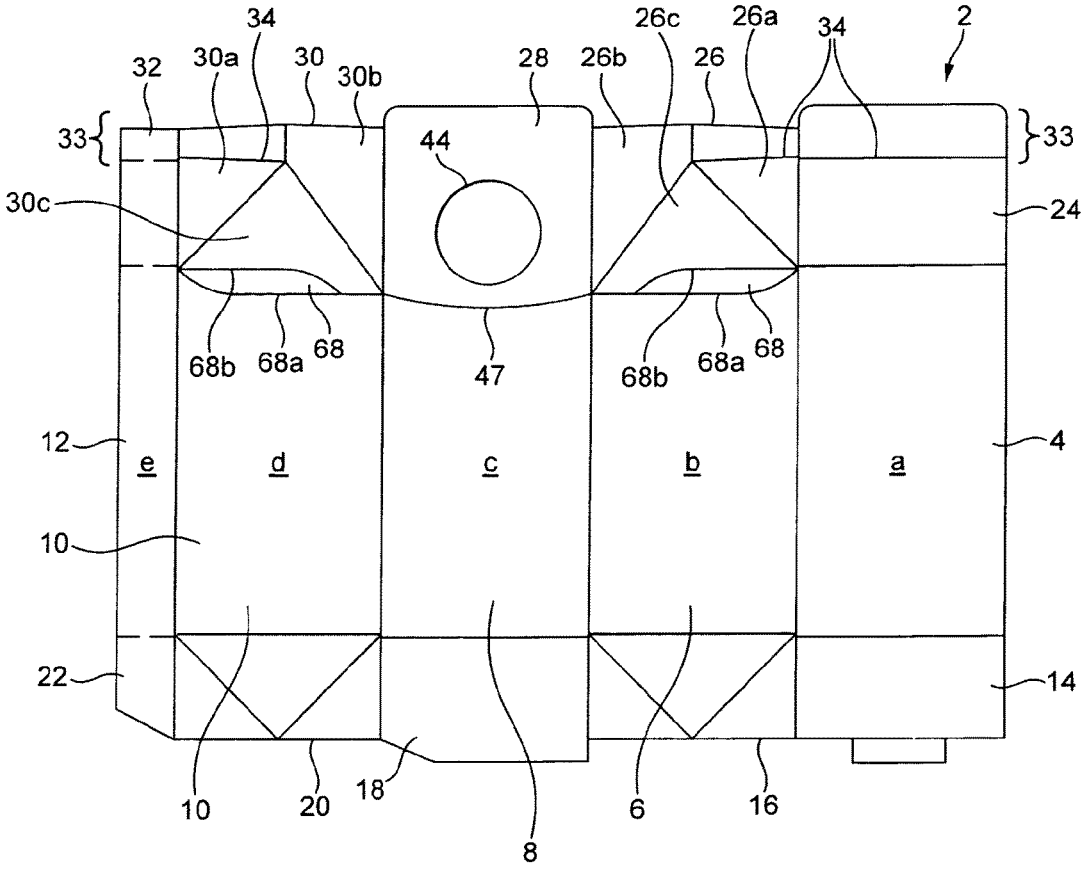
Figure 2:
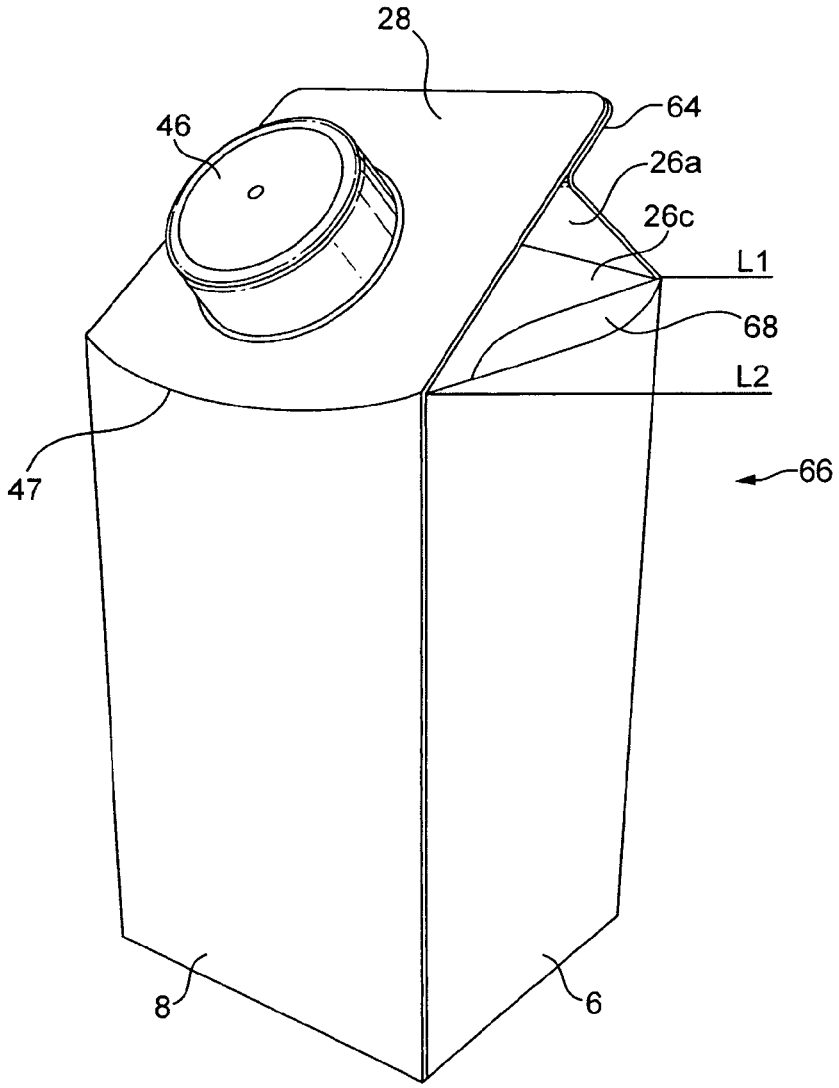
Figure 3:
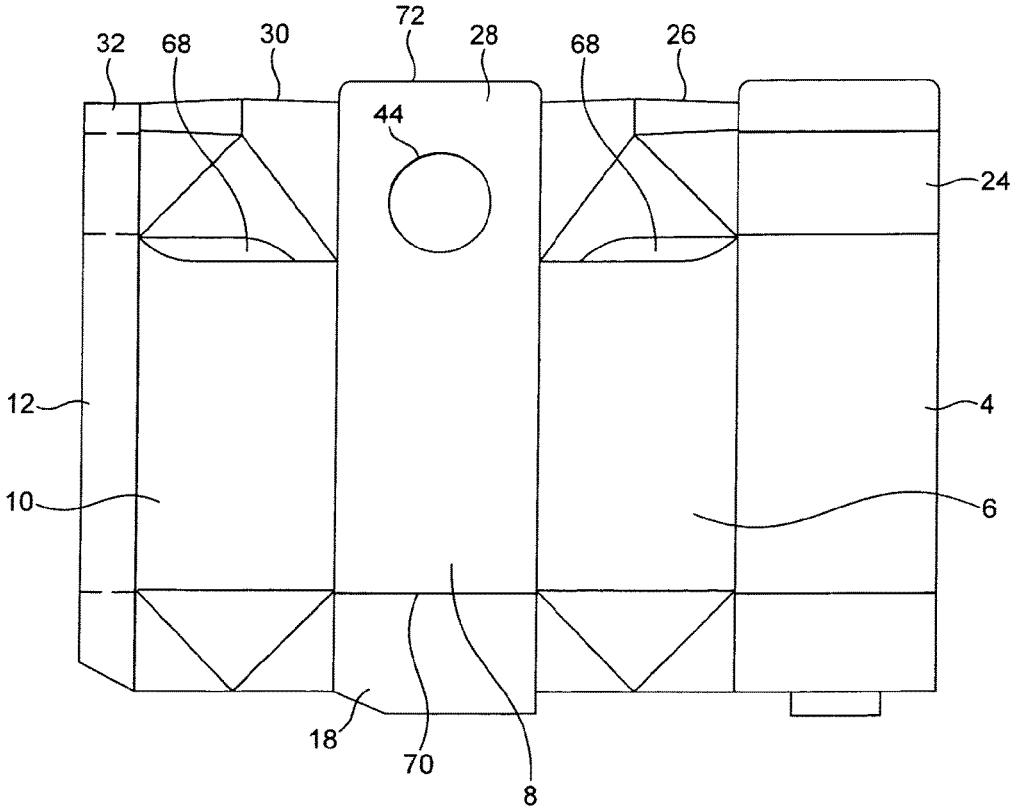
Figure 4:
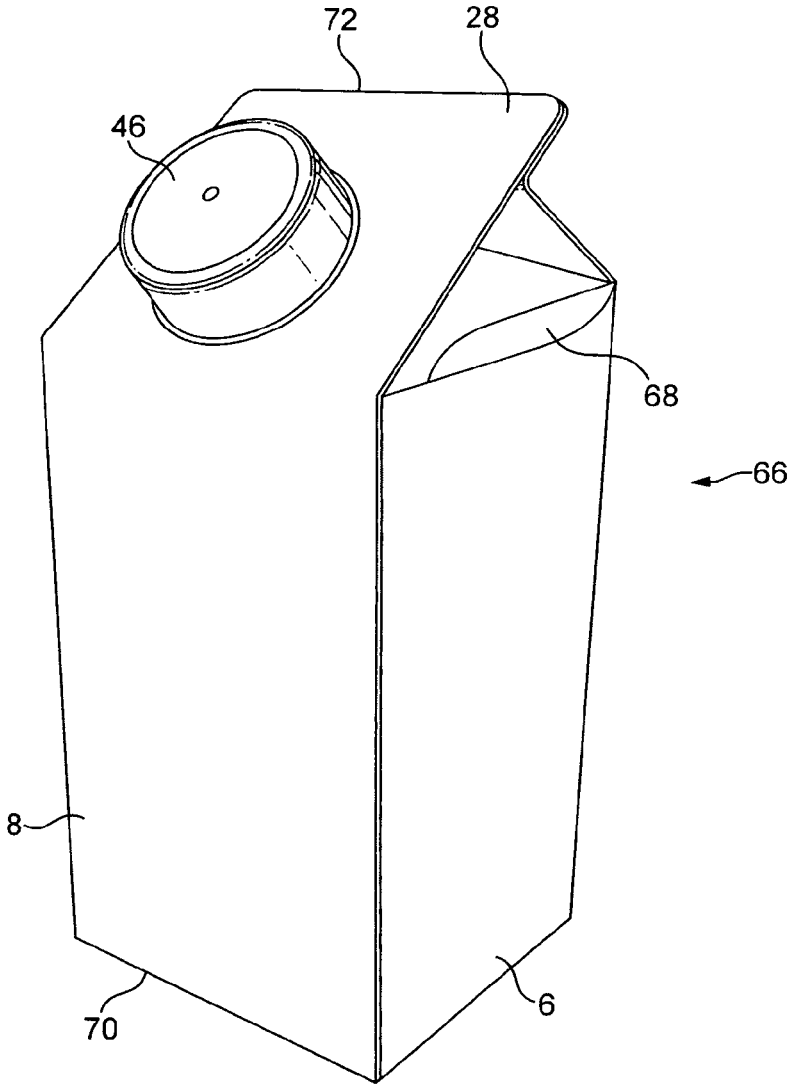
Figure 5:
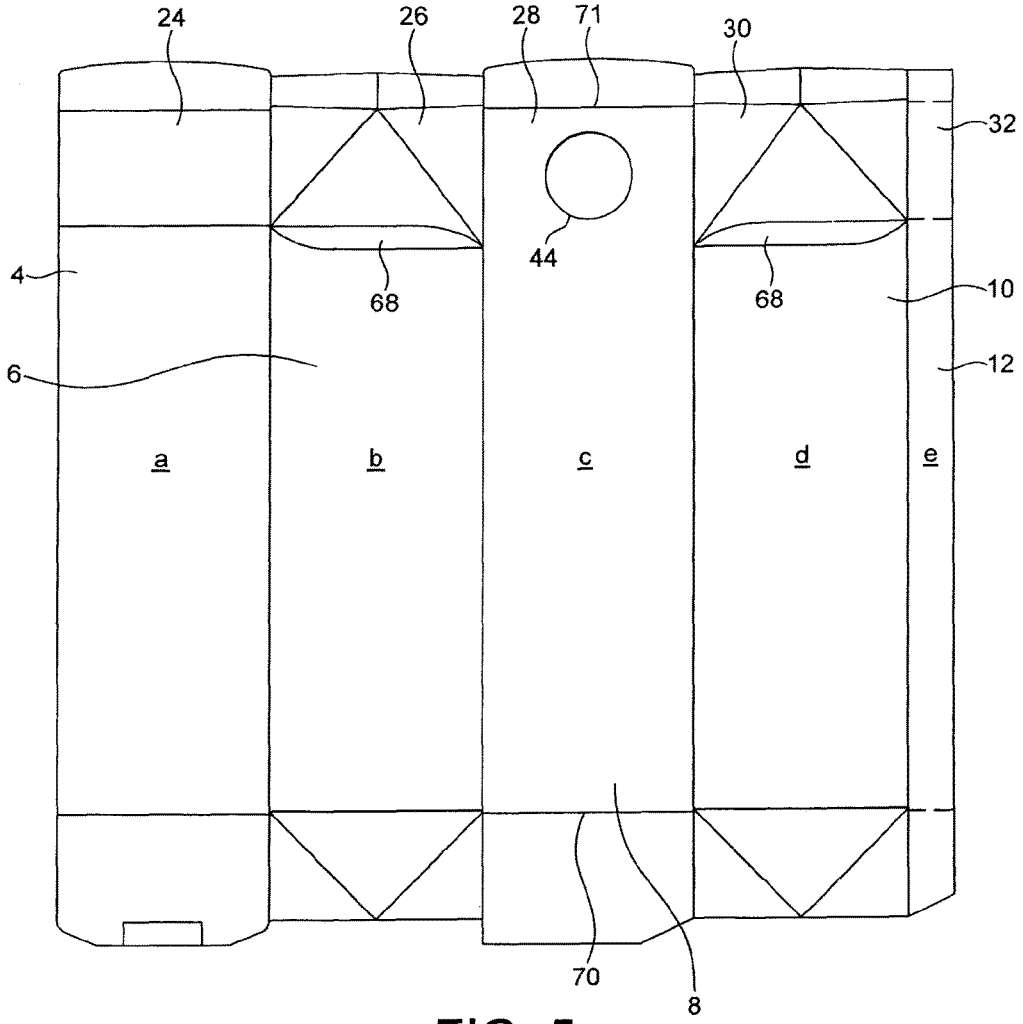
Figure 6:
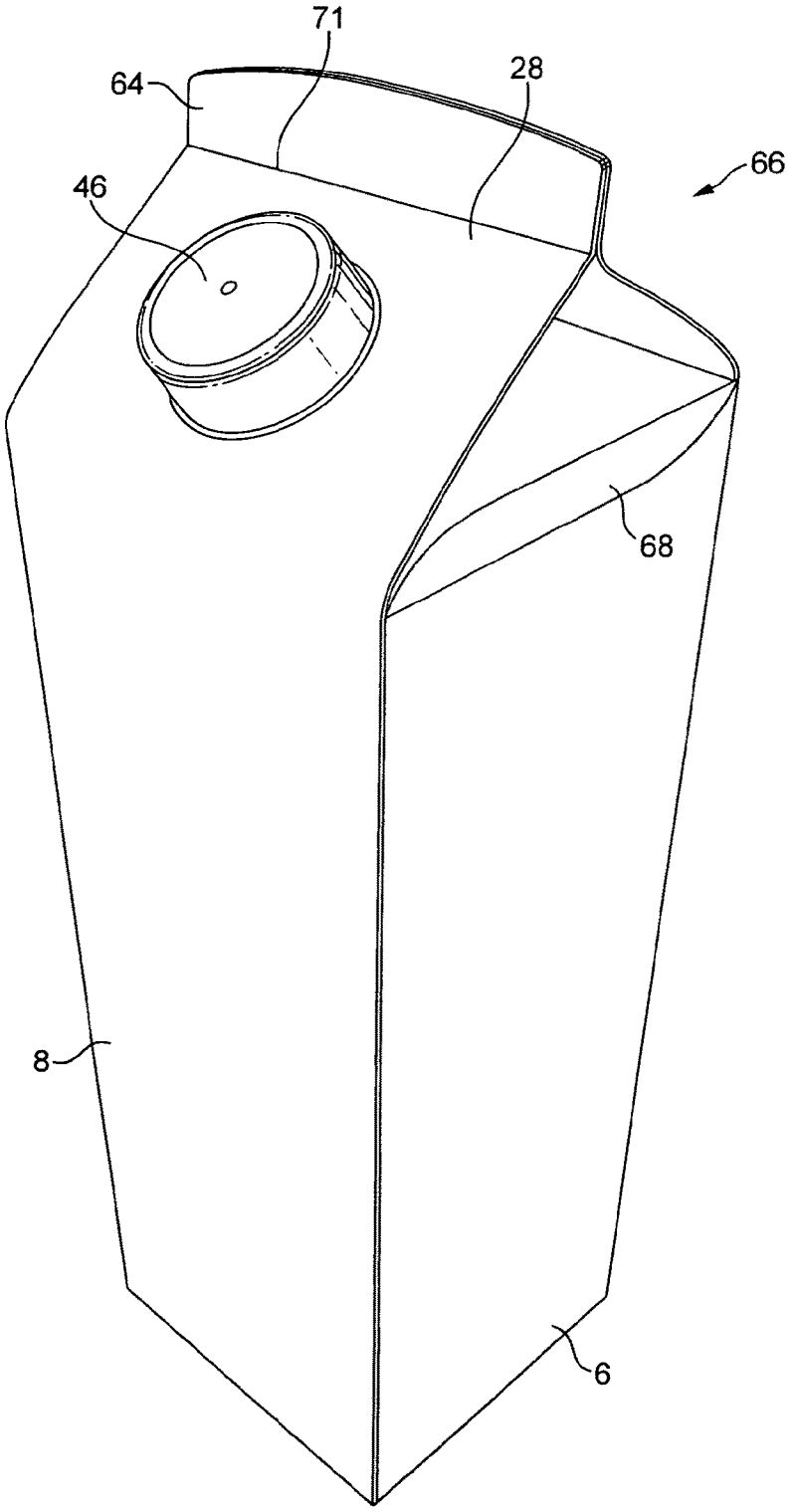
Figure 7:
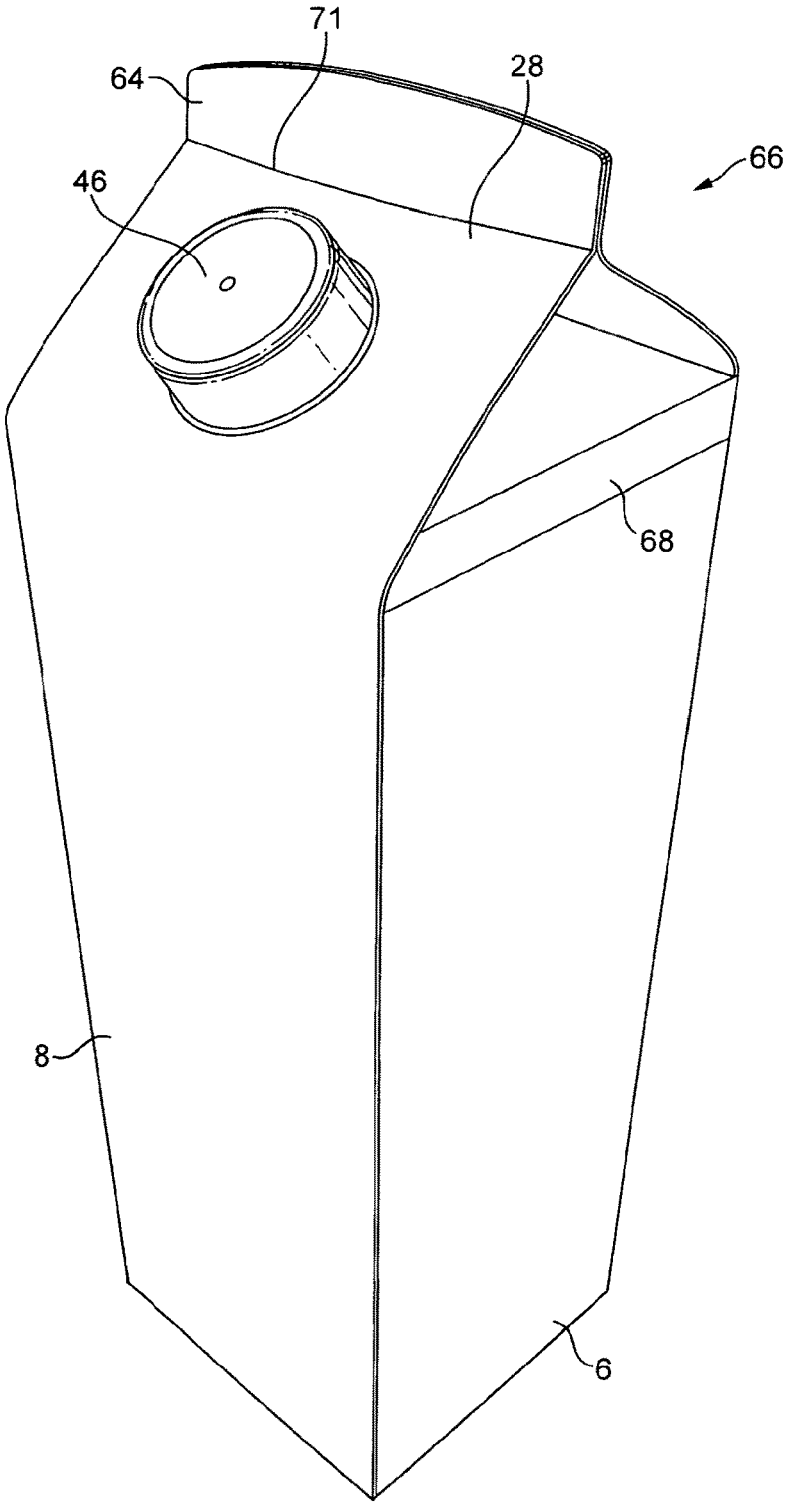
Figure 8:
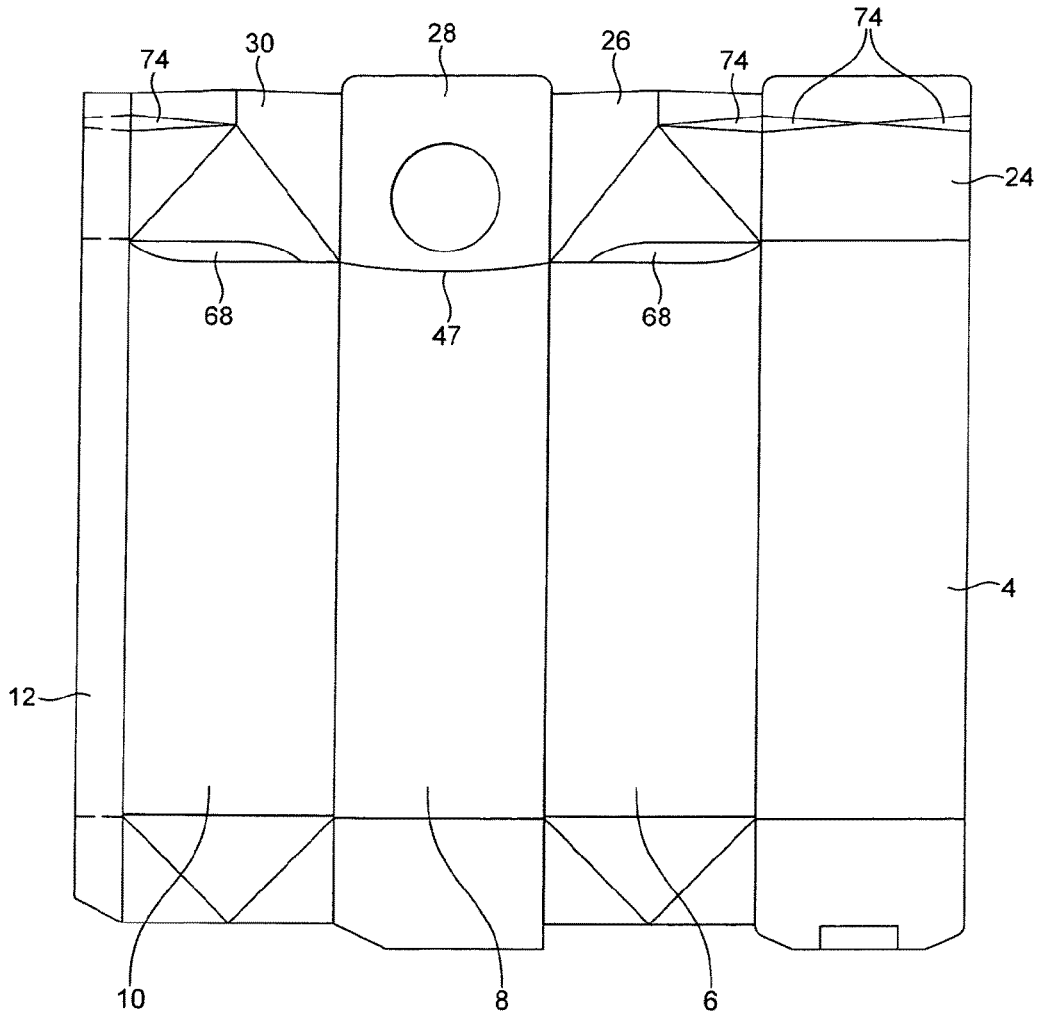
Figure 9:
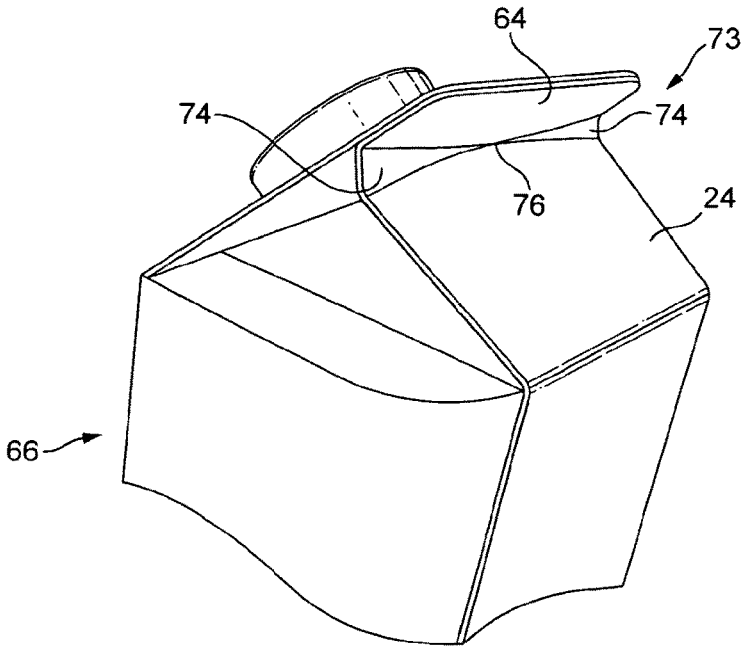
Figure 10:
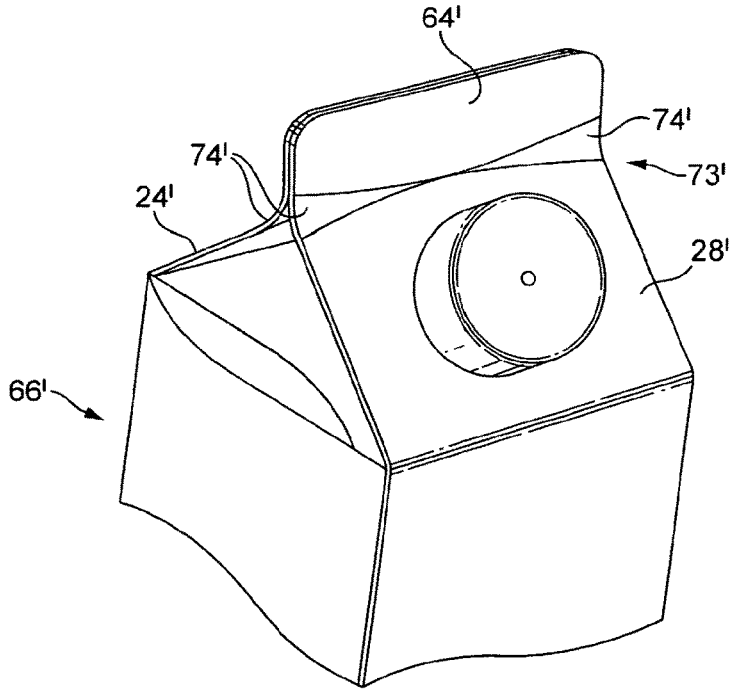

In order that the invention may be clearly and completely disclosed, reference will now be made, by way of example, to the accompanying drawings, in which:

FIG. 1 shows a plan view of a carton blank from which a gable-top carton is made, FIG. 2 is a perspective view of a formed, filled and sealed gable-top carton made from the blank of FIG. 1, FIG. 3 is a view similar to FIG. 1, but of a blank from which a modified version of the carton is made, FIG. 4 is a view similar to FIG. 2, but of the modified version of the carton, FIG. 5 is a view similar to FIG. 1, but of a blank from which a further modified version of the carton is made, FIG. 6 is a view similar to FIG. 2, but of a further modified version of the carton, FIG. 7 is a view similar to FIG. 6, but of yet a further modified version of the carton, FIG. 8 is a plan view of a carton blank similar to FIG. 1, but of another version from which another version of a gable-top carton is made, FIG. 9 is a perspective view of a top portion of a gable-top carton with a slanted top-fin made from the blank of FIG. 5, and FIG. 10 is a view similar to FIG. 9, but with a vertical top-fin.

Referring to FIG. 1, the carton blank 2 is of a semi-rigid plastics-coated paperboard material, possibly with the interposition of an oxygen barrier layer and comprises a row of panels a to e consisting of a row of side wall parts 4 to 12 consisting of a rear side wall part 4, a lateral side wall part 6, a front side wall part 8, another lateral side wall part 10 and a side-seam part 12; a row of bottom obturating parts 14 to 22; a row of top obturating parts 24 to 32; and a narrow top sealing region 33 comprised of respective top sealing fin parts extending across the top edge of the blank 2. The obturating parts 26 and 30 comprise substantially triangular sub-parts 26*a, b* and *c* and 30*a, b* and *c*. The obturating part 24 located above the rear side wall part 4 is separated from the sealing region 33 by a rectilinear line of weakness 34 and the obturating parts 26 and 30 located above the lateral side wall parts 6 and 10 also have a rectilinear line of weakness 34 separating them from the sealing region, but which extends across only approximately half of the width of the obturating parts 26 and 30. The front, top, obturating part 28 is formed with a through-hole 44 (or alternatively a loop of weakness) to which is applied a pour spout fitment 46 (see FIG. 2) but is free from lines of weakness extending inwardly from lateral edge zones of the panel c from an innermost boundary of the top obturating part 28 to an outermost boundary of the adjacent top sealing fin part. In order to allow a larger fitment 46 to be mounted in the roof sub-panel 28 than would otherwise be the case, the obturating part 28 has a boundary with the front side wall part 8 defined by a downwardly bowed line of weakness 47 protruding into the side wall part 8.

When the blank 2 of FIG. 1 has been side-seamed, by the heat-sealing of the so-called fifth panel e to the inside of the panel a, the bottom obturating parts 14 to 22 have been closed and sealed, the desired product, for example milk or fruit juice, has been filled into the open-topped carton thus formed, the top obturating parts 24 to 32 have been closed, and the sealing region 33 sealed to form a rearwardly slanted top sealing fin 64 that is co-planar with the front obturating part 28, the pour spout fitment 46 having been applied before or after top-closure and-sealing of the carton, the formed, filled and sealed, gable-top carton 66 so obtained is as shown in FIG. 2. The carton 66 of FIG. 2, at all levels of the side wall parts 6,8, 10 and 12, is of square cross-section. In order to form the slanted top-fin 64, the top closure sealer jaws of the form-fill-seal machine (not shown), of which there are two; a front sealer jaw and a rear sealer jaw, have, in the sealing position, sealing faces arranged obliquely at an angle of the desired degree of slant and are arranged substantially parallelly to each other. Advantageously, the sealing of the sealing fin parts is by hot-air sealing, although other sealing methods are also usable, such as ultrasonic sealing. In a non-sealing position, the sealing faces may or may not be in an obliquely arranged position, for example, they may be in a substantially vertical orientation.

With conventional gable-top cartons with vertical top fins, during the top sealing, the movement of the sealer jaws relative to the laminate packaging material can tend to scratch the material, especially on the top sealing region. However, when the front obturating part and the top-fin are co-planar with each other, as shown in FIG. 2, the front sealer jaw will not cause such scratching of the packaging material, such that printing of the packaging material (carried out whilst still in the form of the blank 2) can take place over the whole area of the obturating part 28 including the sealing region of that part.

With the absence of a line of weakness between the front obturating part 28 and the sealing region 33, the slanted top-fin 64 is more likely to remain in the desired slanted position, co-planar with the front obturating part 28, as there is no weakness to promote turning of the laminate material. This provides for a relatively mechanically stronger top-fin area since it is more difficult to turn the top-fin 64 relative to the obturating part 28.

It will be noted from FIG. 1, that the rear side wall part 4 is longer in the vertical direction than the front side wall part 8, such that the rear obturating part 24 is of a smaller surface area than the front obturating part 28. Thus, the carton 66 of FIG. 2 has an asymmetric type of gable-top closure, where the height of the rear side wall part 4 reaches a greater upper level L1 than the upper level L2 of the front side wall part 8.

In order to be able to fold the blank 2 of FIG. 1 in the gable area, gable transition sub-panels 68 are provided between respective ones of the substantially triangular sub-parts 26*c* and 30*c* of the obturating parts 26 and 30 and respective side wall parts 6 and 10. The gable transition sub-panels 68 are bounded by a lower line of weakness 68*a* at their boundary with the side wall parts 6 and 10 and by an upper line of weakness 68*b* at their boundary with the substantially triangular sub-parts 26*c* and 30*c*. The lines of weakness 68*a* and 68*b*, along a proportion of their length, are substantially parallel to each other, with one converging towards the other at either end of each gable transition sub-panel 68 forming a lanceolate-type shape. Each of the gable transition sub-panels 68, in the version shown, do not extend the whole way across the width of the substantially triangular sub-parts 26*c* and 30*c*, but such an arrangement is, of course, a possibility (as shown in FIGS. 5, 6 and 8). In addition, each transition sub-panel 68 may comprise a plurality of lines of weakness. The side wall parts 6 and 10 have respective opposite upper corner zones; the outer upper corner zones (or rearward upper corner zones in the completed carton) furthest from the boundary zone between the side wall part 8 and the obturating part 28 being at a level above that boundary zone, whilst the inner upper corner zones (or forward upper corner zones in the completed carton) closest to and adjacent that boundary zone are at substantially the same level as that boundary zone. When the carton blank is folded in the gable area during the carton forming process, the amount of turning from between the side wall parts 6 and 10 to the oblique angle of the substantially triangular sub-parts 26*c* and 30*c* is reduced by the presence of the gable transition sub-panels 68. This way of folding the gable area of the carton not only reduces the presence of abrupt edges in that region that would otherwise be present with a single line of weakness in this area, and which depending on the size of the carton may be a holding region, but the gable transition sub-panels 68 also reduce the chances of stretching and/or cracking of the laminate material, especially at the lower, forward corner regions of the gables. The gable transition sub-panels 68 also form a convenient advertising area.

The version of the blank and carton shown in FIGS. 3 and 4 respectively differs from that of FIGS. 1 and 2 in that the line of weakness 47 is also omitted, so that, from a substantially horizontal line of weakness 70 at an outermost boundary of the side wall part 8, separating the front side wall part 8 and its adjacent bottom obturating part 18, to the outermost boundary of the sealing fin part, that is the top edge 72 of the carton, there are no lines of weakness extending inwardly from lateral edge zones of the panel c. The only line of weakness that is present is the through-hole 44 (or alternatively a loop of weakness) for the pour spout fitment 46. The absence of the line of weakness 47 allows not only even further greater flexibility in the size of the pour spout fitment to be attached than the line of weakness 47 allows, but also allows greater flexibility in the number of parts of the gable-top-forming devices needed in the machine, for example, no special devices or parts for forming the downwardly bowed line of weakness 47 are needed, although devices or parts may be needed to control where bending of the laminate material occurs.

The version of the blank and cartons shown in FIGS. 5 and 6 respectively, differ from that of the previous versions in that the gable-top carton formed has a vertical top-fin 64 and there is a substantially horizontal line of weakness 71 between the top obturating part 28 and its adjacent sealing fin part, i.e. the panel c is free from lines of weakness extending inwardly from lateral edge zones thereof from an outermost boundary of the side wall part 8 (its lowermost boundary) to the outermost boundary of the adjacent obturating part 28 (its uppermost boundary). The advantage of the absence of the line of weakness 47 is described immediately above. This version is deemed to be advantageous in that it is envisaged that a production line can be set up using existing form-fill-seal machines without significant modifications being made thereto.

Referring to FIG. 7, the carton 66 differs from the carton of FIG. 6 in that the transition sub-panel 68 in the gable is of a different form and that the line of weakness 71 is slightly downwardly bowed with respective outer ends of the line of weakness 71 reaching a higher extent than those ends of the substantially horizontal line of weakness 71 in FIG. 6. Such a downwardly bowed line of weakness 71 allows for a small extension to the area of the obturating part 28 which results in a larger area for printing-on.

Referring to FIGS. 8 and 9, a similar principle to that of the gable transition sub-panels 68 can be applied to a boundary zone 73 between the front and/or rear obturating parts 24 and 28 and the top-fin 64 of the carton 66. Referring specifically to FIG. 9, with the rearwardly slanted top fin 64, there is an acute angle formed between the rear top obturating part 24 and the top-fin 64, and the presence of a top transition sub-panel arrangement 74 bounded by lines of weakness, which diverge outwardly, at the boundary zone 73 can reduce the risk of unwanted stretching and/or cracking of the laminate material when the carton is formed, filled and sealed. In the arrangement 74 shown, two such top transition sub-panels of substantially triangular shape are utilised and which extend from respective outer opposite lateral edge zones of the boundary zone 73 to respective apices directed inwardly towards a central region of the boundary zone 73. At the central region of the boundary zone, the apices do not touch, but are joined by a short line of weakness 76, since that central region is one of the most significant leakage channels in the carton and thus requires the deepest region of sealing possible.

As with the gable transition sub-panels 68, having a pair of lines of weakness allows for a less abrupt transition in the folding of an angle. The top transition sub-panels 74 also reduce the risk of unwanted stretching and/or cracking of the laminate material at a point where there are a plurality of layers of the material at the boundary zone 73 and where an acute angle is to be formed. It will be noted from FIG. 8 that the top obturating parts 26 and 30 also include top transition sub-panels 74 immediately adjacent those of the rear top obturating part 24 when the blank has been side-sealed into a carton sleeve. These top transition sub-panels 74 of the obturating parts 26 and 30 will be folded immediately face-to-face behind those top transition sub-panels 74 on the rear top obturating part 24 when the gable-top closure is formed.

Referring to FIG. 10, it differs from FIG. 9 in that the carton 66' has a vertical top-fin 64' and the top transition panel arrangement 74' is located at the boundary zone 73' of the front and rear top obturating parts 24' and 28' with the top-fin 64'.

The gable transition sub-panels 68 may or may not be present with the top transition sub-panel arrangement 74, 74'.

The invention claimed is:

1. A carton blank of semi-rigid plastics-coated paperboard material for forming a carton, and comprising a row of first, second, third and fourth substantially four-edged panels separated by respective lines of weakness, each panel having substantially the same width and comprising a side wall part, a top closure obturating part, a bottom obturating part and a top sealing fin part, the top closure obturating part of one of said panels including a loop of weakness for a pour spout fitment, said one of said panels comprising a line of weakness separating the side wall part and the bottom obturating part, said one of said panels from an outermost boundary of the side wall part to an outermost boundary of the top closure obturating part being free from any line of weakness extending inwardly from lateral edges of said one of said panels.

2. The carton blank according to claim 1, wherein lines of weakness extend in a boundary zone between the first obturating part and the first sealing fin part, the lines of weakness bounding a transition sub-panel arrangement and diverge outwardly.

3. The carton blank according to claim 1, wherein said loop of weakness is a through hole for a pour spout fitment.

4. The carton blank according to claim 3, wherein lines of weakness extend in a boundary zone between the first obturating part and the first sealing fin part, the lines of weakness bounding a transition sub-panel arrangement and diverge outwardly.

5. The carton blank according to claim 1, wherein:

first and third obturating parts are quadrangular, the first obturating part being of a smaller surface area than that of the third obturating part, second and fourth obturating parts each being comprised of substantially triangular sub-parts of which two have boundaries with extents substantially coextensive with the extents of the respective first and third obturating parts, there being transition sub-panels bounded by respective inner lines of weakness at respective second and fourth side wall parts and respective outer lines of weakness at respective further substantially triangular sub-parts of the second and fourth obturating parts.

6. The carton blank according to claim 5, wherein lines of weakness extend in a boundary zone between the first obturating part and the first sealing fin part, the lines of weakness bounding a transition sub-panel arrangement and diverge outwardly.

7. The carton blank according to claim 5, wherein said loop of weakness is a through hole for a pour spout fitment.

8. A carton of semi-rigid plastics-coated paperboard material comprising a loop of first, second, third and fourth substantially four-edged panels separated by respective lines of weakness, each panel having substantially the same width and comprising a side wall part, a top closure obturating part, a bottom obturating part and a top sealing fin part, the top closure obturating part of one of said panels including a loop of weakness for a pour spout fitment, said one of said panels comprising a line of weakness separating the side wall part and the bottom obturating part, said one of said panels from an outermost boundary of the side wall part to an outermost boundary of the top closure obturating part being free from any line of weakness extending inwardly from lateral edges of said one of said panels.

9. The carton according to claim 8, wherein lines of weakness extend in a boundary zone between the first obturating part and the first sealing fin part, the lines of weakness bounding a transition sub-panel arrangement and diverge outwardly.

10. The carton according to claim 8, wherein said loop of weakness is a through hole for a pour spout fitment.

11. The carton according to claim 10, wherein lines of weakness extend in a boundary zone between the first obturating part and the first sealing fin part, the lines of weakness bounding a transition sub-panel arrangement and diverge outwardly.

12. The carton according to claim 8, wherein:— first and third obturating parts are substantially rectangular and, respectively, rearward and forward top obturating parts, the first obturating part being of a smaller surface area than the third obturating part, second and fourth obturating parts each being comprised of substantially triangular sub-parts of which two have boundaries with extents substantially coextensive with the extents of the respective first and third obturating parts, the first and third obturating parts being in conditions turned inwards about their respective inner boundaries, each said further substantially triangular sub-part being in a condition turned inwards about its inner boundary, there being transition sub-panels bounded by respective inner lines of weakness at said second and fourth side wall parts and respective outer lines of weakness at respective further substantially triangular sub-parts of the second and fourth obturating parts.

13. The carton according to claim 12, wherein said loop of weakness is a through hole for a pour spout fitment.

14. The carton according to claim 12, wherein lines of weakness extend in a boundary zone between the first obturating part and the first sealing fin part, the lines of weakness bounding a transition sub-panel arrangement and diverge outwardly.

* * * * *